US006310429B1

(12) United States Patent
Schyndel

(10) Patent No.: US 6,310,429 B1
(45) Date of Patent: Oct. 30, 2001

(54) ACOUSTIC WAVE TRANSDUCER DEVICE

(75) Inventor: Andre John Van Schyndel, Kanata (CA)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/080,189

(22) Filed: May 18, 1998

(51) Int. Cl.[7] ..... H01H 41/04

(52) U.S. Cl. ..... 310/367; 310/313 R; 310/311; 310/319

(58) Field of Search ..... 310/311, 312, 310/313 R, 319, 367

(56) References Cited

U.S. PATENT DOCUMENTS

| | | | | |
|---|---|---|---|---|
| 4,044,273 | * | 8/1977 | Kanda et al. | 310/313 R |
| 4,144,508 | * | 3/1979 | Lewis et al. | 333/191 |
| 4,194,171 | * | 3/1980 | Jelks | 333/149 |
| 4,367,504 | * | 1/1983 | Seki et al. | 360/109 |
| 5,237,542 | | 8/1993 | Burke et al. | 367/103 |
| 5,327,397 | | 7/1994 | Burke et al. | 367/103 |
| 5,373,483 | | 12/1994 | Burke et al. | 367/103 |
| 5,708,402 | * | 1/1998 | Hachisu et al. | 333/133 |

FOREIGN PATENT DOCUMENTS 198 08 151 * 2/1999 (DE) ..... 310/367

OTHER PUBLICATIONS

Proceedings of the Second Technical Conference on Telecommunications R & D in Massachusetts; University of Massachusetts Lowell, MA 01854; Mar. 12, 1996.

The Interactive Balloon: Sensing, Actuation, and Behavior in a Common Object by J.A. Paradiso; IBM Systems Journal, vol. 35, NOS 3&4, 1996—0018–8670/96.

* cited by examiner

*Primary Examiner*—Thomas M. Dougherty
(74) *Attorney, Agent, or Firm*—Jeffrey M. Measures

(57) ABSTRACT

An acoustic wave transceiver device comprising a sheet of material which responds electrically to acoustic waves and a signal processor which processes the voltage signal produced by the sheet is disclosed. The sheet has an irregular shape which depends on a width function. The sheet produces a voltage signal representing the convolution of the acoustic signal information in a received wave and the width function. The signal processor deconvolves the voltage signal using said width function which is stored in its memory. A method of selecting the width function (and therefor the shape) based on the Fourier transform of a mathematical relation with orthogonal properties is also disclosed.

32 Claims, 8 Drawing Sheets

ACOUSTIC WAVE TRANSDUCER DEVICE

FIELD OF THE INVENTION

The present invention relates to acoustic wave transducer devices, for example microphones, hydrophones, sonar systems, etc.

BACKGROUND TO THE INVENTION

Note that although the present invention relates generally to acoustic waves and to acoustic wave receivers/transducers, for clarity we will refer to the most common examples, namely sound waves and microphones. Some classes of microphone transducer technologies which are known to the audio community are: carbon, condenser, moving-coil (or "dynamic") and piezoelectric. Using these technologies microphones with varying sensitivity to direction, proximity, impedance and frequency can be constructed. Some of these are: cardioid, pressure gradient, and microphone array. The existing background literature in this field is extensive, however, some very good technology reviews are described in references: L. Beranek, Acoustics, American Institute of Physics, New York, N.Y., 1986; and L. E. Kinsler, *Fundamentals of Acoustics,* John Wiley & Sons, Inc., New York, N.Y., 1982. In addition, microphone manufacturers (for example B&K Shure and Electrovoice) have application notes and product literature which describe the performance of these devices.

Indeed, the review articles and the current literature describe a need for microphone systems which have increasingly larger signal to noise ratio, and increasingly larger directional sensitivity (i.e., increased sensitivity to acoustic waves originating from a particular direction). While the devices described above address these needs to some degree, problems still exist. For example, current state-of-the-art microphones with relatively high signal to noise ratios tend to be sufficiently large to scatter the waves, thus affecting the received sound waves. This is problematic as it both distorts the signal produced by the microphone, as well as changes the waves for subsequent receivers or listeners.

Other background information which may be useful in understanding the invention and the techniques described herein is found in: Horowitz and Hill, *The Art of Electronics,* McGraw-Hill; S. W. Golomb, *Shift Register Sequences,* Aegean Park Press, 1982; and G. Arfken, *Mathematical Methods for Physicists,* Academic Press, Inc., New York, N.Y., 1985, which are all hereby incorporated by reference.

SUMMARY OF THE INVENTION

In accordance with a broad aspect of the present invention there is provided an acoustic wave transducer device comprising a material which produces a voltage signal dependent on the shape of the material and on the pressure applied to the material by an acoustic wave, wherein said material is of an irregular shape.

A material such as PVDF (polyvinylidene fluoride) can be used. Materials like PVDF have been used to form transducers before, but have not been formed into sheets with irregular shapes, as described herein, or have been coupled to signal processor which uses the shape of the transducer sheet as described herein.

Preferably, the shape of a sheet of material which forms the transducer is selected in order to advantageously convolve acoustic signal information with a width function dependent on the shape of the sheet. Thus the transducer can be used to produce desired voltage signals representing the convolution of an input signal with a known function by shaping said transducer according to said known function. Alternatively, a signal processor can deconvolve a voltage signal produced by the sheet into a signal indicative of the pressure applied to the transducer by an acoustic wave in order to determine the acoustic signal information. The acoustic signal information is a time dependent function carried by said acoustic wave which is often useful as it represents desired information, for example voice or music carried by sound waves.

The shape of the sheet can be thought of as encoding spatial information about the acoustic wave into the voltage signal produced by the sheet, which is useful in order to preferentially extract desired acoustic signal information.

In accordance with another aspect of the invention there is provided an acoustic wave transducer device comprising:

a material which produces a voltage signal dependent on the shape of the material and on the pressure applied to the material by an acoustic wave, wherein said material is of a predetermined shape; and a signal processor for producing an output signal indicative of the pressure applied to the material by processing said voltage signal using said predetermined shape.

As the material is cut to a predetermined shape the signal processor can produce an output signal, indicative of the pressure applied to the material by the acoustic wave, by processing said voltage signal using said predetermined shape. Thus the signal processor includes a memory for storing shape function data dependent on said predetermined shape and uses the shape function data to produce the output signal. The predetermined shape can be defined in terms of a width function and a shape function. The shape function data depends on the width function.

In particular, the transducer produces a voltage signal which represents the convolution of the width function with the acoustic signal information in the acoustic wave. The signal processor subsequently uses the stored shape function data to deconvolve the voltage signal to retrieve the acoustic signal information (i.e., produces an output signal, indicative of the pressure applied to the material by the acoustic wave).

According to another aspect of the invention there is provided a method of making an acoustic wave transducer device comprising the steps of:

selecting a mathematical relation with orthogonal properties; transforming said relation to form a width function; and forming a transducer whose shape depends on said width function.

According to such a method, a transducer may be formed from at least one sheet of material which produces a voltage signal dependent on the shape of the sheet and on the pressure applied to the sheet by an acoustic wave. Preferably the shape of said transducer is derived from said width function such that the shape has an irregular width which varies with the length of the transducer, and a length which is longer then the longest wavelength of the acoustic waves to be received.

Advantageously, a transducer device can be formed which produces a higher signal to noise ratio than conventional transducers. Preferably such a transducer device includes means for increasing the sensitivity of the device to acoustic waves originating from a selected direction. Preferably said transducer device comprises a sheet (or sheets) with negligible thickness, an irregular width which varies along the length of the sheet, and a length which is longer then the longest wavelength of the acoustic waves to be received, said sheet having a sheet axis and wherein said means for increasing the sensitivity of the device to acoustic waves originating from a selected direction comprises means for selecting an angle between said sheet axis and said selected direction.

BRIEF DESCRIPTION OF THE DRAWING

The present invention, together with further objects and advantages thereof will be further understood from the following description of the preferred embodiments with reference to the drawings in which:

FIG. 1*a* is a three dimensional schematic drawing illustrating an acoustic wave transducer device according to an embodiment of the invention, for which

DETAILED DESCRIPTION OF THE PREFERRED EMBODIMENTS

Figure 1A:
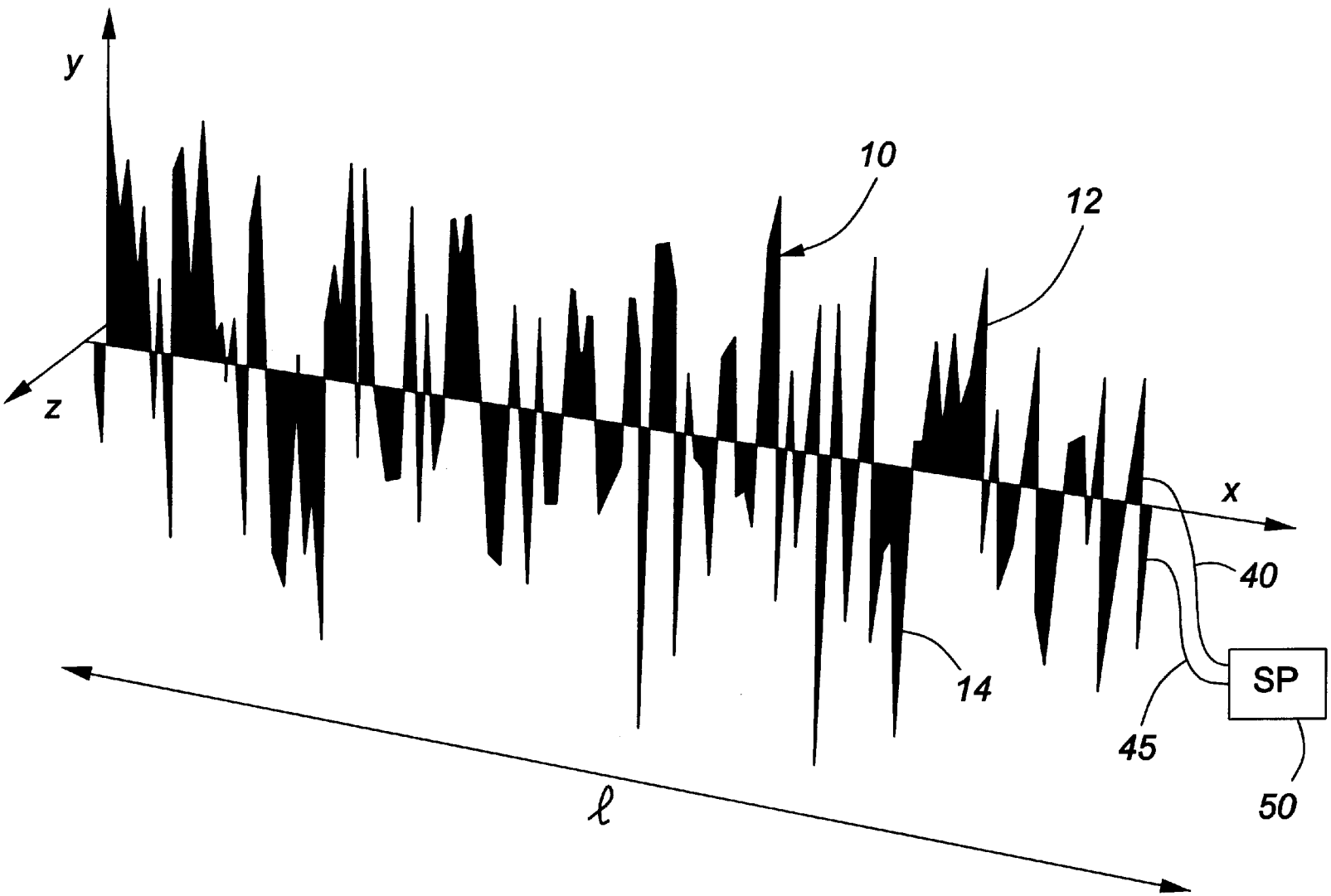

An acoustic wave transducer device according to the invention is made from a material that responds electrically to the pressure applied to it by an acoustic wave. We will describe the preferred embodiments of the invention with reference to a transducer made from a material which produces a voltage signal dependent on the shape of the material and on the pressure applied to the material by an acoustic wave (e.g. PVDF (polyvinylidene fluoride), Electret sensing material, or an Electrostatic membrane sensing material). A transducer made from an ideal sheet of this material would have an output voltage developed across it which depends on the sum of the pressure at each point according to the function:

$$V(t) = S_0 \iint_S p(\vec{r}, t)\, dS \tag{1}$$

wherein $\vec{r}$ represents a generalized spatial position vector, $S_0$ is the intrinsic sensitivity of the material in $$\frac{\text{Volts}}{\text{Pa m}^2},$$

and S represents the total surface of the transducer.

Equation 1 holds generally for transducers of an arbitrary shape. However, the voltage signal produced by any arbitrary transducer may not be useful. In particular, it may be very difficult to translate such a voltage signal into a signal indicative of the pressure applied to the transducer by an acoustic wave in order to determine the acoustic signal information. The acoustic signal information is a time dependent function carried by said acoustic wave which is often useful as it represents desired information, for example voice or music carried by sound waves.

These difficulties can be overcome by utilizing transducers which satisfy some assumptions relating to the shape of the transducer and the orientation of the transducer in space with respect to an acoustic wave. Thus, in order to simplify understanding of the operation and advantages of the preferred embodiments of the invention, we will discuss the analysis of a recording of the output voltage from a transducer as an acoustic wave traverses it This discussion is facillitated by way of a couple of examples.

EXAMPLE 1

We will first consider the example of a transducer comprising sheet of such a material in a Cartesian co-ordinate system wherein:

1. The thickness of the sheet is small, such that we only need consider the pressure at the surface of the material by an acoustic wave. In other words, the thickness of the sheet is sufficiently small that the effects due to the thickness of the sheet can be ignored.
2. The sheet lies in the xy plane, beginning at x=0, extending in the positive x direction for a length (1) and centered on y=0 such that y=0 when w(x)=0.
3. The sheet has a sheet axis which determines a width function w, the magnitude of which is equal to the width of the sheet as a function of its length. In the examples described herein, the sheet axis is the x-axis, and the width function is a function of x only and is labeled w(x). Methods of constructing a sheet with a negative value of w(x) are described below.
4. The sound source is located relatively far from the sheet in the negative x-direction such that the sound wave can be considered a plane wave p(x,t) coming from the negative x-direction.
5. For illustration purposes, assume the material has $S_0$=1, so that $S_0$ need not appear in the equations.

In this example, Equation (1) can be simplified so that a sheet as described above would have an instantaneous output of:

$$V(t) = \int_0^l p(x, t)\, w(x)\, dx \tag{2}$$

Plane waves are described by $p(x,t)=\mathrm{Re}\{e^{\omega t(0x-\vec{k}\cdot\vec{r})}\}=\cos[\omega(t-\vec{k}\cdot\vec{r}/c)]$ where $\vec{r}$ is the position vector and $\vec{k}$ points in the direction of wave propagation and has a magnitude ω/c, where c is the speed of wave propagation (e.g., the speed of sound).

Note that (as the name "plane wave" suggests), the pressure is constant on planes described by x=constant because $\hat{x}\cdot\vec{r}$=x=constant ($\hat{x}$ is a unit vector pointing along the x axis). We can therefore describe the pressure as:

$$p(x,t)=\cos[\omega(t-x/c)] \tag{3}$$

Another property of a wave of this description is that, the pressure at a certain position and time is equal to the pressure at a farther distance down the x-axis at a later time (because the pressure wave is traveling down the x-axis—along the length of the sheet).

Therefore:

$$p(x, t) = p\left(x + \chi(x, t), t + \frac{\chi(x, t)}{c}\right) \tag{4}$$

where the offset $\chi(x,t)$is an arbitrary function of x and t. substitution into the pressure equation (equation 3) shows that the offset does not change the pressure:

$$p(x, t) = \cos\left[\omega\left\{\left(t + \frac{\chi(x, t)}{c}\right) - \left(\frac{x + \chi(x, t)}{c}\right)\right\}\right] = \cos[\omega(t - x/c)] \tag{5}$$

which is the same as Equation 3.

Substituting Equation 4 into Equation 2 and choosing $\chi(x,t)=-x$, we obtain:

$$V(t) = \int_0^1 p(0, t - x/c)w(x)dx \tag{6}$$

Note that:

w(x)=0 for x<0 or x>1, so we can write Equation 6 as $$V(t) = \int_{-\infty}^{\infty} p(0, t - x/c)w(x)dx \tag{7}$$

Further, if we let $x=c\tau$, then:

$$V(t) = \int_{-\infty}^{\infty} p'(t - \tau)w'(\tau)d(\tau) \tag{8}$$

where $w'(\tau)=cw(c\tau)$ and $p'(t-\tau)=p(0,t-\tau)$

As Equation 8 is a standard convolution, a signal processor (SP) can retrieve p'(t)=p(0,t) by performing a deconvolution, according to:

$$p(0, t) = \int_{-\infty}^{\infty} V(t - \tau)W'(\tau)d\tau \tag{9}$$

where $$W'(\tau) = F^{-1}\left\{\frac{1}{F\{w'(\tau)\}}\right\}$$

and F{ }and $F^{-1}${ }denote the Fourier and inverse Fourier transforms respectively:

$$F\{g(t)\} = \frac{1}{\sqrt{2\pi}}\int_{-\infty}^{\infty} g(\tau)e^{i\omega\tau}d\tau \quad \text{and} \tag{10}$$

$$F^{-1}\{g(\omega)\} = \frac{1}{\sqrt{2\pi}}\int_{-\infty}^{\infty} g(\omega)e^{-i\omega\tau}d\omega$$

Note that in this example the function $W'(\tau)$ is dependent only on the width function w(x) and the speed of sound. Thus a signal processor which receives the voltage signal from a sheet whose shape depends on said width function w(x) can produce an output signal, p(0,t), indicative of the pressure applied to the sheet (and hence indicative of the signal information), by processing said voltage signal using said width function w(x).

In operation, the signal processor receives the voltage signal generated by the sheet in the presence of an acoustic wave, and produces an output signal whose voltage varies with p(0,t) and thus reproduces the acoustic signal information in the received acoustic wave (subject to time delays due to propagation of the wave and DSP processing delays). This output can be recorded, analyzed, broadcast, etc. depending on the desired application. The actual method steps carried out by the signal processor according to this embodiment will be discussed below with reference to the flowchart of FIG. 4.

From the above equations, one can see that in effect, the transducer produces a voltage signal which represents the convolution of the width function w(x) and the acoustic signal information in the acoustic wave. The signal processor subsequently deconvolves the voltage signal to retrieve the desired signal information (i.e., p(0,t)).

It is desirable to select a width function which allows the signal processor to preferentially extract the desired signal information. According to one such objective, the width function w(x) is chosen so as to maximize the Signal to Noise ratio (S:N) of the output signal. However, according to another objective, the width function w(x) can be adjusted to maximize the directional sensitivity of the system. In practice, the actual width function w(x) selected may represent a tradeoff between these two objectives.

In order to maximize the signal to noise ratio, we consider how the addition of intrinsic noise affects the voltage signal. Let us assume that such intrinsic noise can be described by another function n(t) which is white Gaussian noise as a function of t (i.e., n(t) is spectrally flat, and if n(t) is sampled at random times, the distribution of these samples will be Gaussian.)

Thus the output voltage signal can be described as:

$$V(t) = n(t) + \int_{-\infty}^{\infty} p'(t - \tau)w'(\tau)d\tau \tag{11}$$

Then, as before:

$$p'(t) = p(0, t) = \int_{-\infty}^{\infty} [V(t - \tau) + n(t - \tau)]W'(\tau)d\tau \tag{12}$$

Optimum choices for w(x) would minimize the influence of n(t) on the calculation of p'(t)=p(0,t), or in other words, maximize the signal to noise ratio:

$$S:N = \sqrt{\frac{\langle[\int_{-\infty}^{\infty} V(t - \tau)W'(\tau)d\tau]^2\rangle}{\langle[\int_{-\infty}^{\infty} n(t - \tau)W'(\tau)d\tau]^2\rangle}} \tag{13}$$

Selecting a width function which maximizes this equation (13) is not a straight-forward process. However, some properties of shapes which produce high signal to noise ratios are discussed below. However, we first describe another example which changes assumption 4 of Example 1.

EXAMPLE 2

Example 2 shows the deconvolution equations used to process a voltage signal from a sheet in the xy plane wherein the sound source is far from the sheet in the xz plane at an angle θ to the x axis (the z axis is the microphone surface normal). In other words, the sound source is a plane wave with a direction in the xz plane making an angle θ with the x axis.

As in example 1, the instantaneous output of the microphone is:

$$V(t) = \int_0^l p(x, t)w(x)dx \tag{14}$$

As before, the sound wave described above is given by $p=\cos[\omega(t-\vec{k}\cdot\vec{r}/c)]$ where $\vec{k}$ is in the x-z plane making an angle θ with the x axis. Therefore, on the x-y plane, $$\vec{k}\cdot\vec{r} = \frac{\omega}{c}|\vec{r}|\cos\theta = \frac{\omega}{c}x\cos\theta \quad \text{and:}$$

$$p(x, t) = \cos\left[\omega\left(t - \frac{x\cos\theta}{c}\right)\right] \tag{15}$$

Analogous to the plane wave traveling along the x axis, an offset χ(x,t) introduced as $$p(x, t) = p\left(x + \chi(x, t), t + \frac{\chi(x, t)\cos\theta}{c}\right) \tag{16}$$

will not change the pressure.

As before, if we let χ(x,t)=−x then Equation 14 becomes:

$$V(t) = \int_0^l p(0, t - x\cos\theta/c)w(x)dx \tag{17}$$

As before, w(x)=0 for x<0 or x>1, so Equation 17 becomes:

$$V(t) = \int_{-\infty}^{\infty} p(0, t - x/c)w(x)dx \tag{18}$$

Further, if we let x=cτ/cos θ then:

$$V(t) = \int_{-\infty}^{\infty} p'(t-\tau)w'(\tau)d(\tau) \tag{19}$$

$$\text{where } w'(\tau) = \frac{c}{\cos\theta}w\left(\frac{c\tau}{\cos\theta}\right) \text{ and } p'(t-\tau) = p(0, t-\tau)$$

Again, this is a standard convolution form and the signal processor retrieves p'(t)=p(0,t) by performing a deconvolution using W'(τ) and Equation 9 (or Equation 12 when considering the effect of added noise) as set out above. Note that the function W'(τ) is now not only dependent on the shape of the sheet and the speed of sound, but also depends on the angle of the incident sound source (i.e., θ). This allows the acoustic wave transducer device to be very sensitive to acoustic waves originating from a direction offset from the sheet by an angle θ by selecting the value of θ to be used by the signal processor when performing the deconvolution.

Note that these same equations can be used by the signal processor in example 1 (i.e., for a sound source originating in the negative x direction) by setting θ=0

As can be seen from both Example 1 and Example 2, the convolution produced by the transducer, and the corresponding deconvolution during processing depends on the width function w(x). Furthermore, the shape of the transducer depends on the width function w(x) as the magnitude of w(x) is equal to the width of the sheet as a function of its length. Note that the sign of w(x) determines whether the voltage signal component from that portion of the sheet is added to, or subtracted from V(t). This can be accomplished, for example by dividing the sheet into two sub-sheets, wherein one sub-sheet produces positive voltage components when w(x) is positive and the other sub-sheet produces negative voltage components when w(x) is negative. This can be accomplished by reversing the connections between the sheets, or using different materials for each sub-sheet. Note that w(x) can be selected to have only one sign, and thus only requires one sheet.

The shape of the sheet can be described generally as the material lying between an upper boundary $y_+(x)$ and a lower boundary $y_-(x)$ such that $y_+(x)-y_-(x)=w(x)$. The upper and lower boundaries are shown as functions of x because changing the location of any portion of the sheet in the y-direction does not change the resulting voltage, provided the x-co-ordinate and w(x) remain unchanged (assuming the sound source is a plane wave is the xz plane).

We can, therefore, define the shape of the sheet in terms of these boundaries by:

$$y_-(x)=y_s(x)-|w(x)|/2$$

and $$y_+(x)=y_s(x)+|w(x)|/2 \tag{20}$$

wherein $y_s(x)$ can be any function of x. Thus by changing $y_s(x)$ the transducer may take on different shapes with the same width function. Three example shapes with identical width functions will be discussed below with reference to FIGS. 6, 7 and 8.

For some applications, $y_s(x)$ is chosen to minimize the extent of the sheet in the y-dimension in order to best approximate the assumptions made above (e.g., the pressure exerted on the surface of the transducer by an acoustic wave is only a function of x). $y_s(x)=0$ is a suitable function in this respect (note that $y_s(x)$=a constant generally tends to minimize the extent). However alternative functions for $y_s(x)$ may be selected for other applications, for example in order to increase the directional sensitivity to particular directions or for easier construction. For example, setting $y_s(x)=w(x)/2$ allows for each sub-sheet to be formed on one side of the y=0 axis, with the first sub-sheet being bound by $y_+(x)$ and y=0 when w(x)>0 and the second sub-sheet being bound by y=0 and y(x) when w(x)<0.

This is the case in FIG. 1*a* which shows an embodiment of the present invention in a Cartesian co-ordinate system. In this embodiment, a sheet of material 10 of a predetermined shape, comprising a first sub-sheet 12 and a second sub-sheet 14, is connected to a signal processor 50 (labeled as the SP) by means of connectors 40, and 45. Said predetermined shape is defined by the width function w(x) and the shape function $y_s(x)=w(x)/2$. As stated above, w(x) may be negative. In this example, as $y_s(x)=w(x)/2$, a negative width implies that the microphone extends into the negative y direction. One way to accommodate this "negative width", is to physically cut the sheet of material 10 along the x axis into two sub-sheets which are electrically separated. The first sub-sheet 12 extends into the positive y direction whereas the second sub-sheet 14 extends into the negative y direction. The output voltage of the two sub-sheets is then subtracted to form the single output voltage of the composite sheet, for example by reversing the order of the wires 45 connecting the second sheet 14 to the signal processor 50.

Figure 1B:
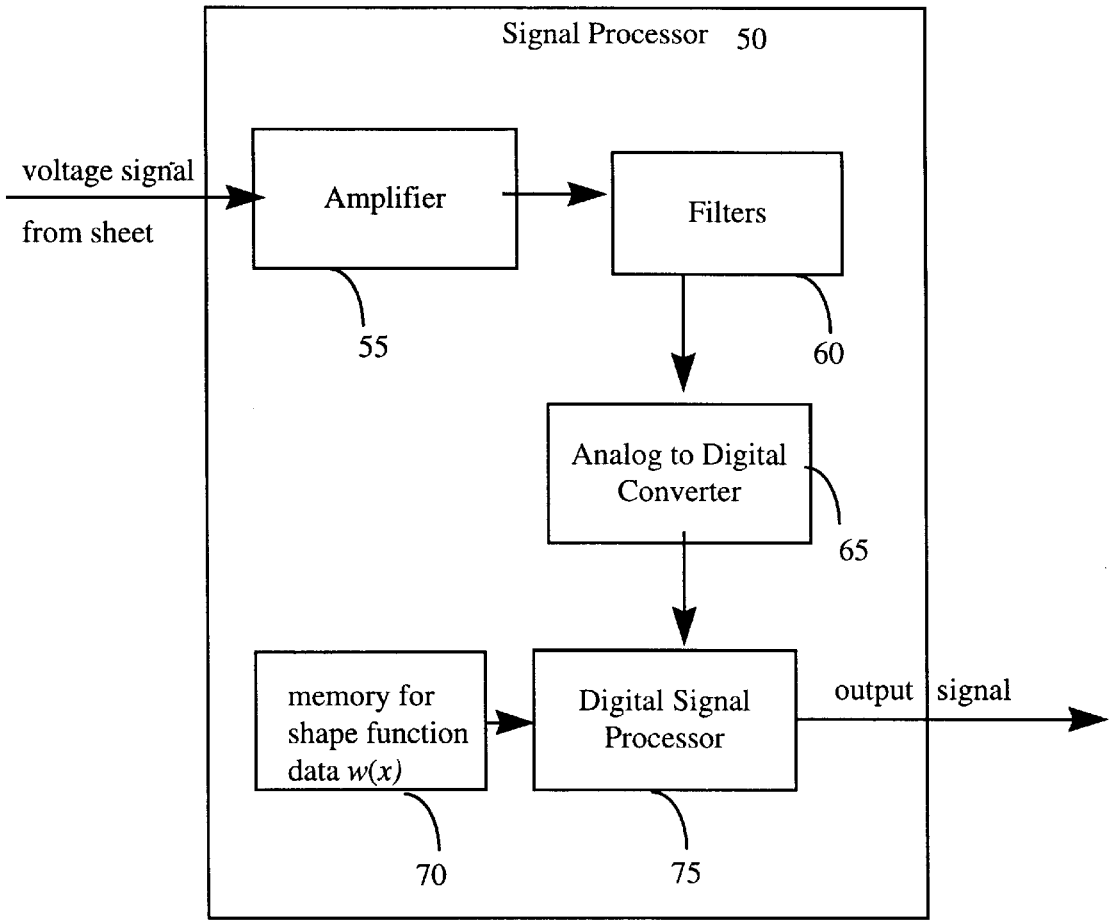
FIG. 1*b* illustrates the details of the signal processor 50 of FIG. 1*a;*

FIG. 1*b* is a schematic block diagram of the signal processor 50, which comprises an amplifier 55 for amplifying the voltage signal received from the sheet 10, filters 60, and analog to digital (A/D) converter 65 for digitizing the amplified and filtered voltage signal. Preferably the A/D converter 65 samples V(t) at a speed at least twice the maximum frequency of V(t) in order to avoid aliasing. The digital signal is then sent to the Digital Signal Processor (DSP) 75 for processing.

In the embodiment of FIG. 1, the signal processor includes a memory 70 for storing shape function data dependent on said width function w(x) and uses the shape function data to produce the output signal p(0,t) by performing the deconvolution as described above. In this example, the shape function data is represented by a stored value of w(x) for each value of x. However, w(x) is not necessarily stored, as long as some intermediate form derived from w(x) which assists in the execution of the deconvolution is stored, for example the Fourier transform of w(x).

We will now discuss desirable properties for the shape of the transducer. As stated above (Equation 20), the shape depends on the width function. As the acoustic wave is convolved with the width function, the shape encodes spatial information about the acoustic wave into said voltage signal. An irregular shape is selected to encode said spatial information such that a signal processor which receives said voltage signal can preferentially extract said signal information from the noise in the voltage signal. This extraction occurs in the deconvolution process and is facilitated by an irregular shape, like the example shown in FIG. 1, wherein said irregular shape is such that the material forms a sheet with small thickness and an irregular width which varies with the length of the sheet. Preferably the length of the sheet is longer then the longest wavelength of the acoustic waves to be received. Preferably, as is the case with the embodiment of FIG. 1, the behavior of w(x) (i.e., the behavior of the width) in a small region of the sheet is different from the behavior of w(x) at the majority of other regions on the sheet. Such an irregular shape typically has rapid changes which add higher frequency components to the signal V(t) than the maximum acoustic frequencies of interest.

An irregular shape is advantageous because the same acoustic wave will produce different voltage signal components as the acoustic wave traverses the various regions of the sheet. The signal processor uses these differences to preferentially extract the signal information. In particular, these differences allow the deconvolution process to extract both the time and spatial information from v(t). In effect, many copies of the pressure wave are sampled and averaged, wherein each sample is produced from a different region of the transducer. As these copies are sampled at different times, and the noise in V(t) is a function of time only (i.e. not a function of x), averaging these copies tends to reduce the total noise (as is known from signal averaging techniques).

From the above, it can be seen that a regular shape, for example a rectangle or triangle would not be an optimum shape, as only a small portion of the sheet would actually contribute to the reproduction of the acoustic wave information.

As stated previously, selecting a width function which maximizes Equation (13) is not a straight-forward process. However, from the above observations, the inventor has realized that selecting a mathematical relation with orthogonal properties can help produce useful width functions which at least produce high signal to noise ratios. For example, a chirp function can be used, as can a pseudo-random noise sequence generated from a maximal-length shift register sequence algorithm. As another example, sequences used in Code Division Multiple Access (CDMA), which are known for their orthogonality, can also be used. These mathematical relations can then be transformed to generate the corresponding width function. For example, taking the inverse Fourier transform of such a mathematical relation generates useful width functions, which are generally satisfactory (i.e., produces a higher S:N ratio than a conventional microphone).

Figure 2:
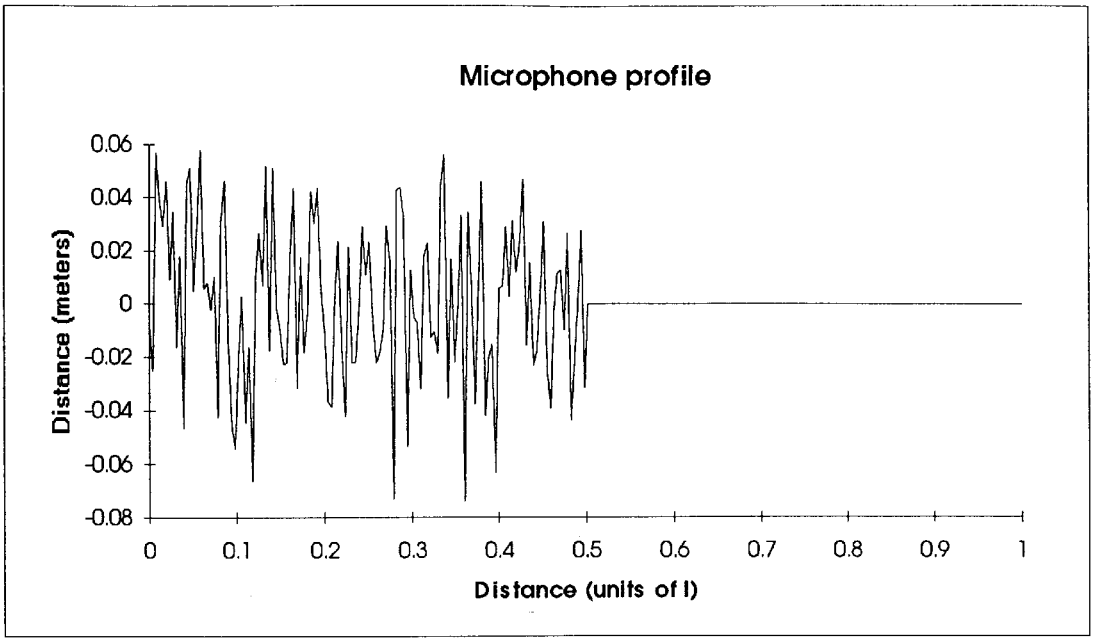
FIG. 2 is a plot of the width function w(x) representing the shape of the acoustic wave transducer device of FIG. 1.
Figure 3:
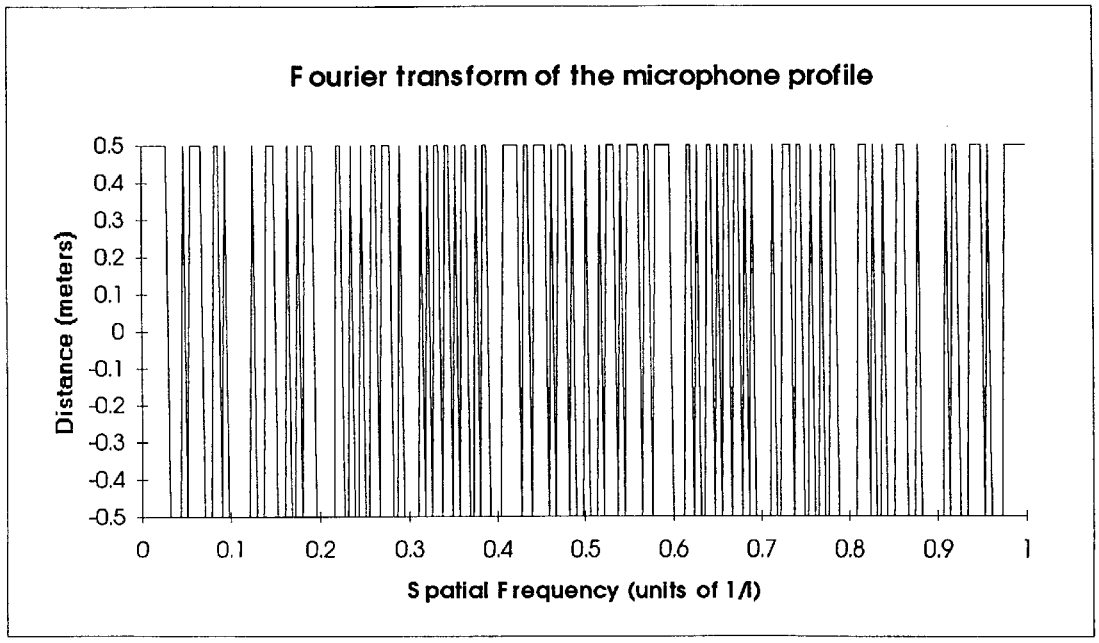
FIG. 3 is a plot of the Fourier transform of the width function w(x) of FIG. 2.
Figure 5:
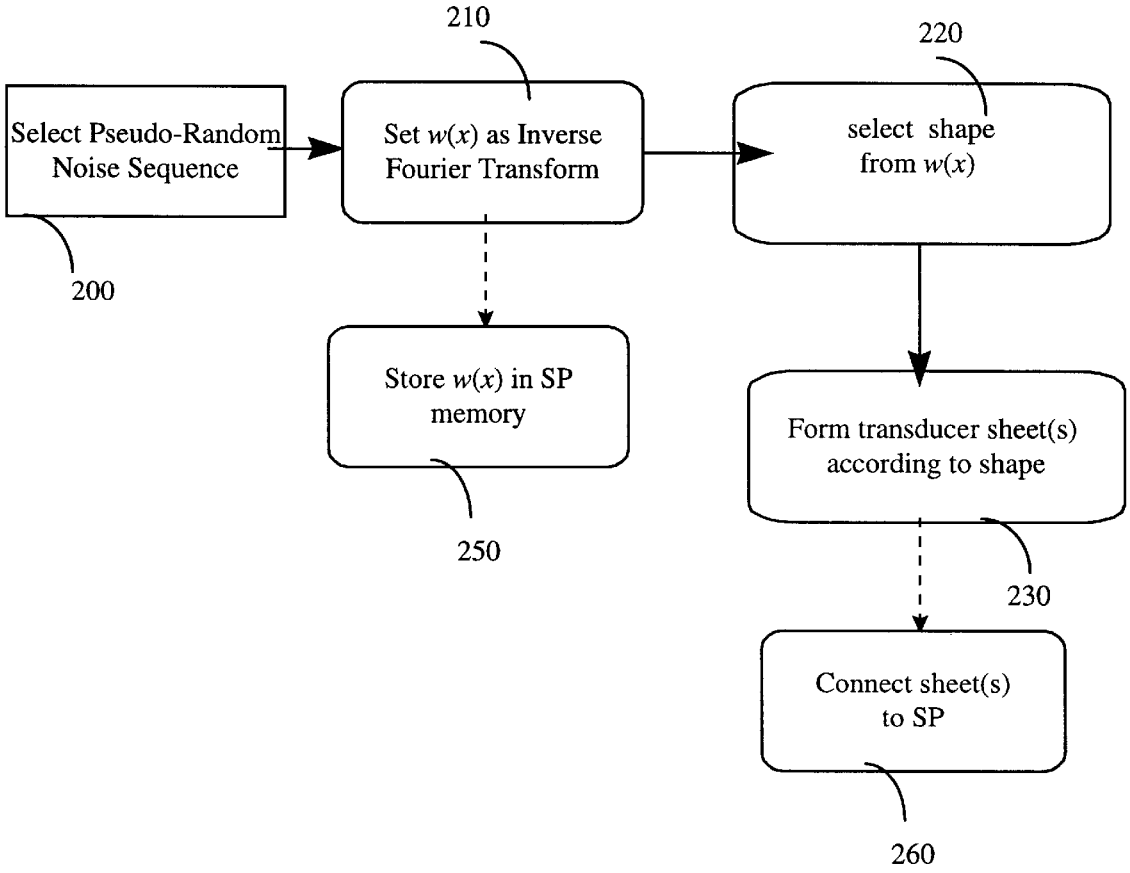
FIG. 5 is a flowchart illustrating the process steps for forming a transducer according an embodiment of the invention.

In the preferred embodiment, the inventor transformed a pseudo-random noise sequence generated from a maximal-length shift register sequence algorithm, into the shape shown in FIG. 1. The corresponding width function is shown in FIG. 2, which is a plot of w(x) as a function of x. This shape was derived by plotting the inverse Fourier transform of the pseudo-random noise sequence illustrated in FIG. 3. Thus a method of making an acoustic wave transducer device according to an embodiment of the invention is shown in FIG. 5 wherein the steps comprise:

selecting a mathematical relation with orthogonal properties, for example a pseudo-random noise sequence generated from a maximal-length shift register sequence algorithm 200; transforming said relation to form the width function, for example, by setting w(x) to the inverse Fourier transform of the pseudo-random noise sequence 210; and forming a transducer whose shape depends on the width function, for example by selecting a shape which depends on the width function 220 and forming transducer sheet(s) according to the selected shape 230, for example by cutting a sheet or sheets of material to the selected shape or by forming a mold corresponding to the selected shape. Step 220 involves selecting the value of the shape function $y_s(x)$. For example, if $y_s(x)=w(x)/2$ is selected, and w(x) changes signs, then the transducer will be formed from two sheets, with each sheet being on either side of a shared horizontal axis (which in this example is the sheet axis). For example, in FIG. 1, one sheet represents all the positive values of w(x), and the other sheet represents all the negative values of w(x), with the shared horizontal axis being the x-axis. In the region of the sheet when w(x) has a particular sign, one sub-sheet will have a positive width and the width of the other sub-sheet will be zero. this makes each sub-sheet discontinuous. Hence each portion of the sub-sheet with a non-zero width has to be electrically coupled, for example, by connecting each portion by wires. To facilitate construction, each sheet can comprise a thin strip with a small width located at the shared horizontal axis, so that each sub-sheet would in fact be continuous, with the two thin strips of the two sub-sheets overlapping.

In addition, the width function w(x) can be stored in the SP memory 250 to be used in deconvolving the voltage signal output from the sheet. The transducer sheet(s) are then connected to the SP 260. As stated, each sub-sheet can be made from a different material such that one sheet produces positive voltage signal components and the other produces negative voltage signal components. Alternatively the sub-sheets can be connected to the SP with the wires reversed.

Figure 7A:
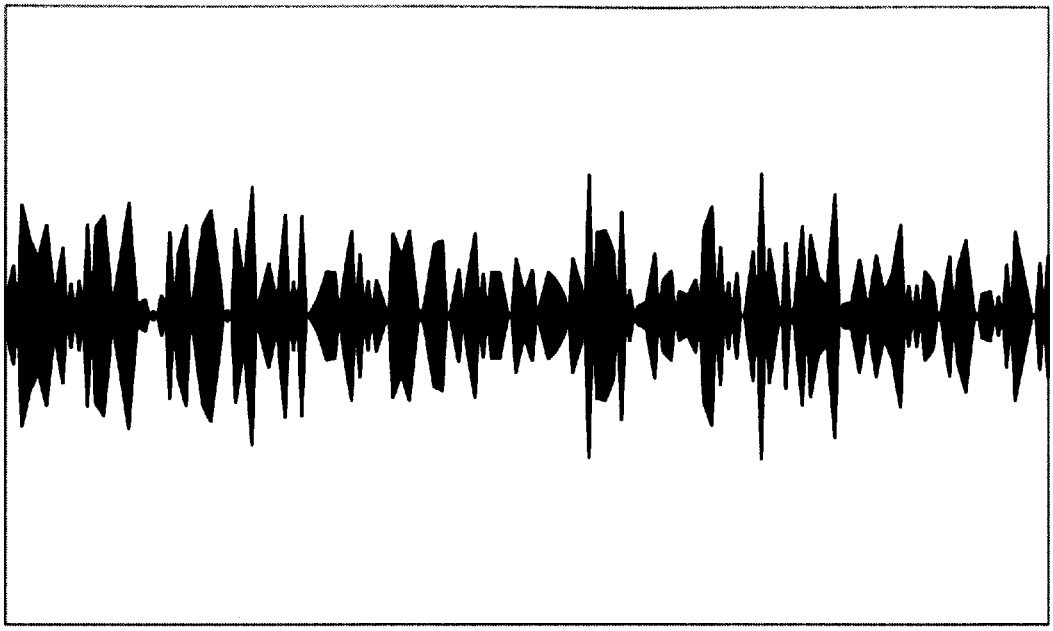
FIG. 7*a* is a schematic drawing illustrating the shape of another transducer having the same width function as that of FIG. 1 and 6.
Figure 7B:
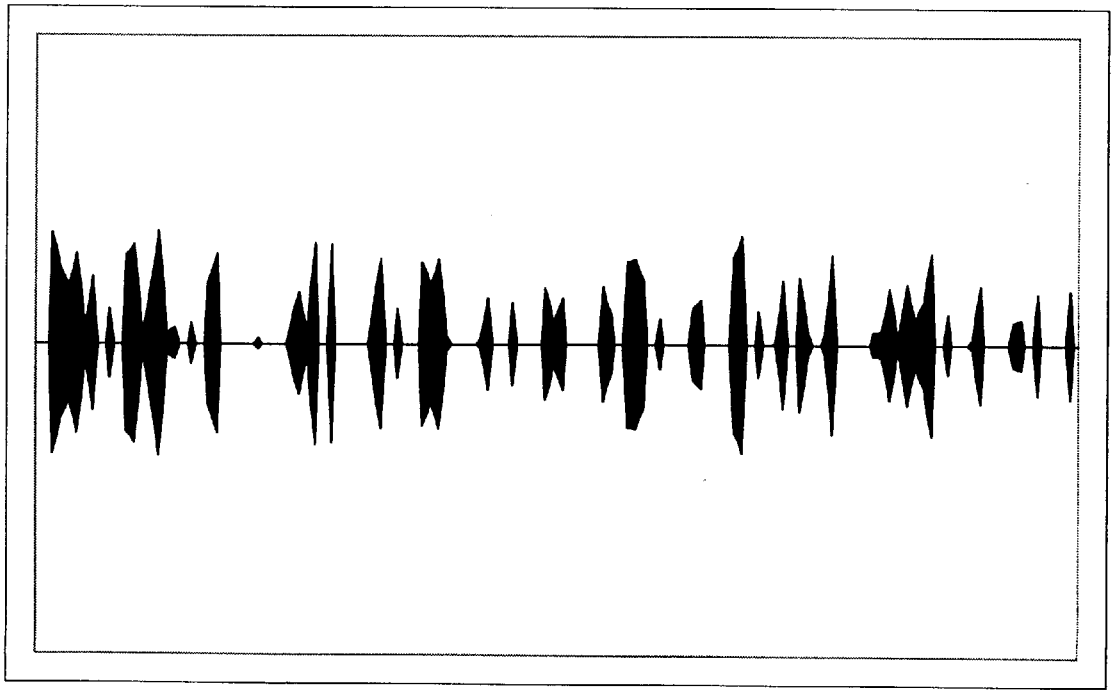
FIGS. 7*b* and *c* illustrate two sub-sheets used to form the sheet of FIG. 7*a*.
Figure 7C:
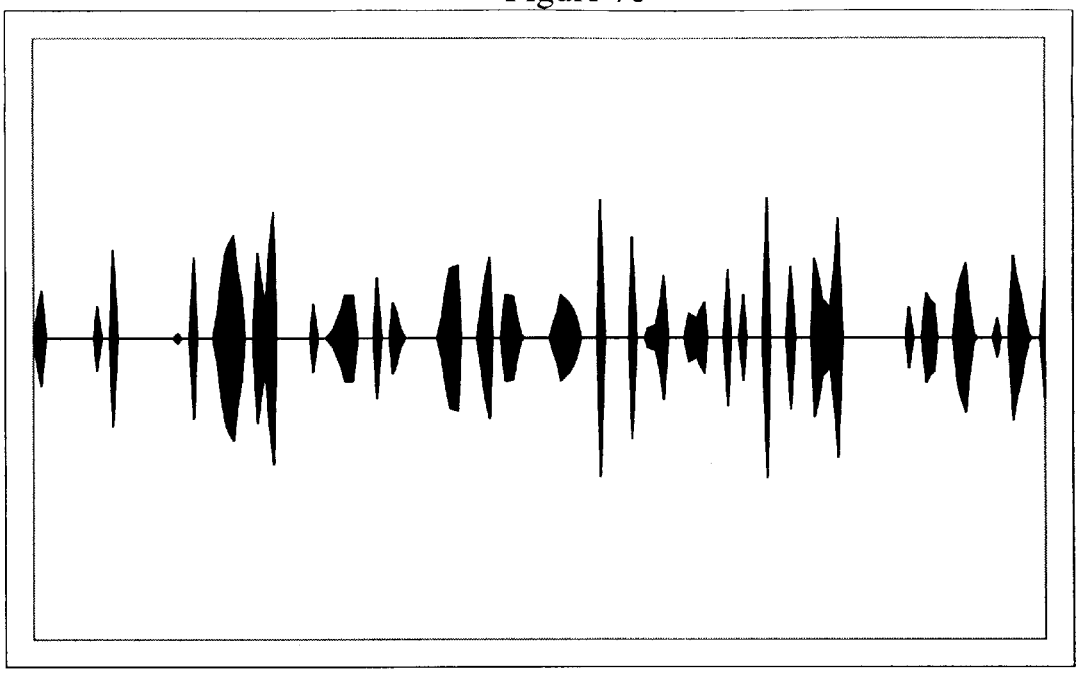
Figure 8:
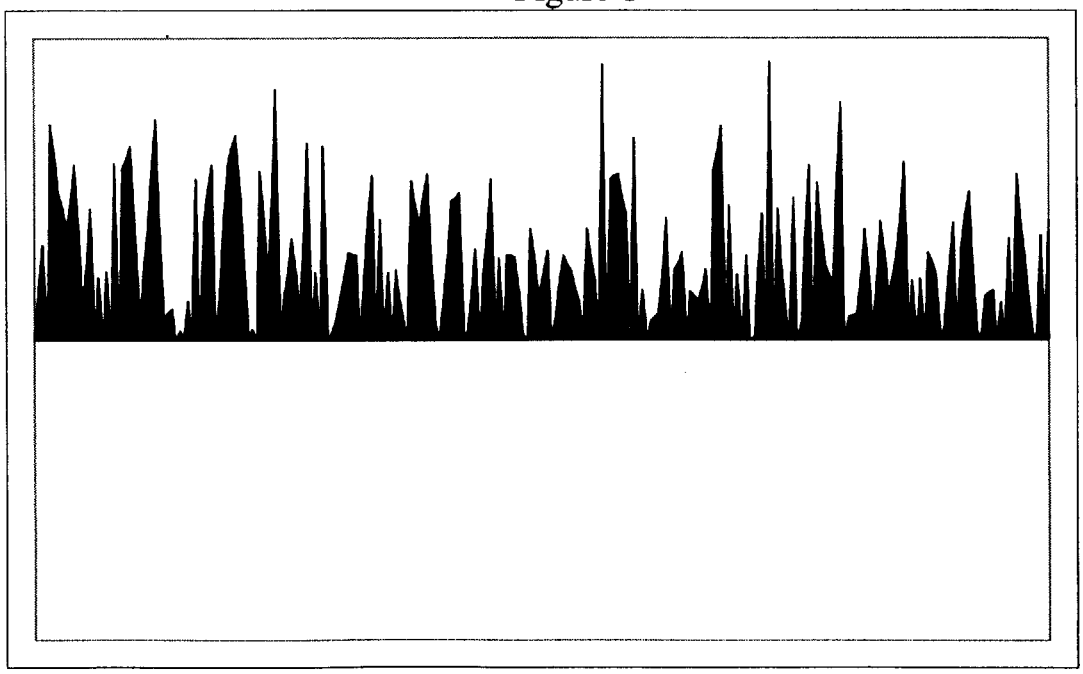
FIG. 8 is a schematic drawing illustrating the shape of yet another transducer having the same width function as that of FIGS. 1, 6, and 7.

As stated, FIG. 1*a* shows a transducer device made according to this method for a specific width function w(x). The sheet(s) of FIG. 1 has a shape function of $y_s(x)=w(x)/2$. FIGS. 7 and 8 illustrate two different transducer sheets having different shape functions but having the same width function w(x). The sheet of FIG. 1 is shown in two dimensions with the same scale as that in FIGS. 7 and 8. FIG. 7 includes 3 drawings for a sheet with $y_s(x)=0$. FIG. 7*a* shows the complete transducer, which is comprised of two sub-sheets, shown in FIGS. 7*b* and 7*c*. FIG. 7*b* shows the sub-sheet for positive w(x) values, and FIG. 7*c* shows the sub-sheet for negative w(x) values. For ease in construction, each sub-sheet will have a thin strip along the y=0 axis connecting all of the portions of "the sheet" together. The composite transducer is constructed by superimposing the sub-sheets together. Note that the extent of the sheet in FIG.

Figure 6:
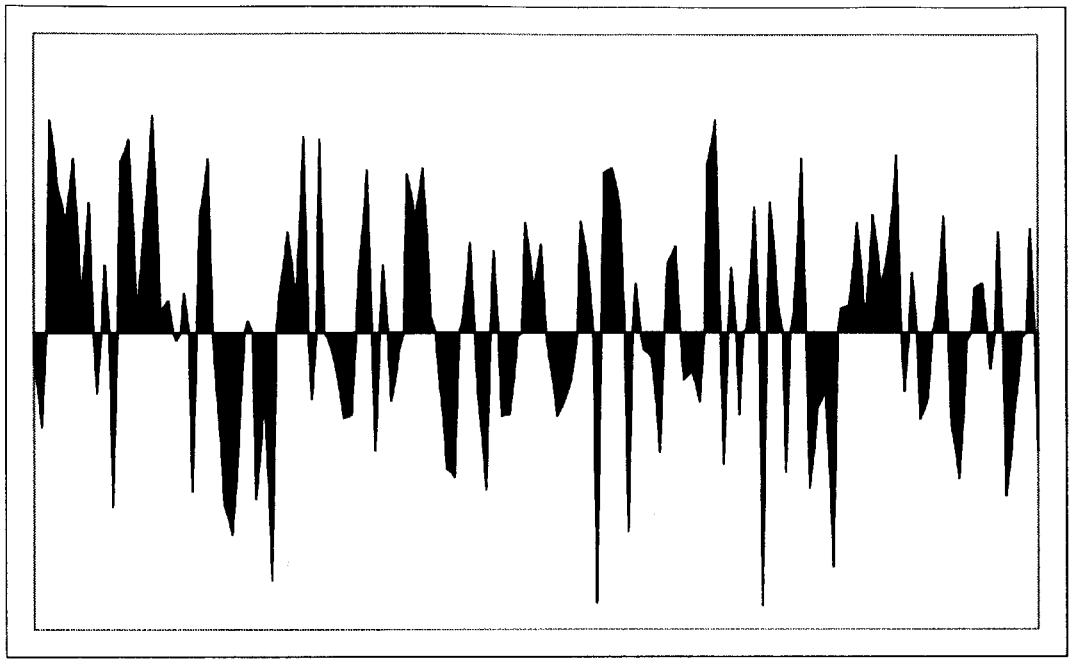
FIG. 6 is a schematic drawing illustrating the shape of the transducer of FIG. 1 in two dimensions, which is used to contrast with other shapes as shown in FIGS. 7 and 8.

7 is less then the extent of FIG. 6, even though they have identical widths. FIG. 8 shows a composite sheet having the negative portion of the sheet flipped over the y=0 axis. In other words, the sheet is made from two super imposed sub-sheets as described for FIG. 7 but with $$y_s(x) = \frac{|w(x)|}{2}.$$

Some of the advantages of this system can be understood by noting the following observations when comparing this system to conventional microphones:

1. The sheet's apparent size looking in the direction of the sound source (i.e., its thickness) is small. This tends to circumvent the sound field distortion problems encountered by microphones that get high signal to noise ratios as a result of their large size. Contrary to these large microphones, a microphone using a transducer as described herein would be essentially "invisible" to other acoustic sensing equipment because a thin sheet in the edge-on orientation effectively does not scatter sound.
2. The sheet can be arbitrarily long (much longer than a wavelength) without averaging out the sound. In fact the longer the sheet is, the more sensitive the microphone is. Preferably, the length is longer then the longest wavelength of the acoustic waves to be received.
3. 
   a) If we collect an audio signal T seconds long using a regular pressure microphone located at x=0, the data is collected over time such that at a time t, the pressure function p(0,t) and the noise function n(t) give V(t)=p(0,t)+n(t). In this equation there is no way to know whether a particular component of V(t) is from the noise or from the pressure signal.
   b) However, in this example, if the sheet length is 1, and we have a sample time of T=1/c, and x=0 is at the leading edge of the sheet, then there is information about p(0,t) coming into V(t) over the entire sample time T. This is used in the preferred embodiments to increase the S:N ratio, as the signal components contribute information over both time and a space function (i.e., the shape), whereas inherent noise added by the system to the voltage signal will largely average out over the length of the sheet.

Figure 4:
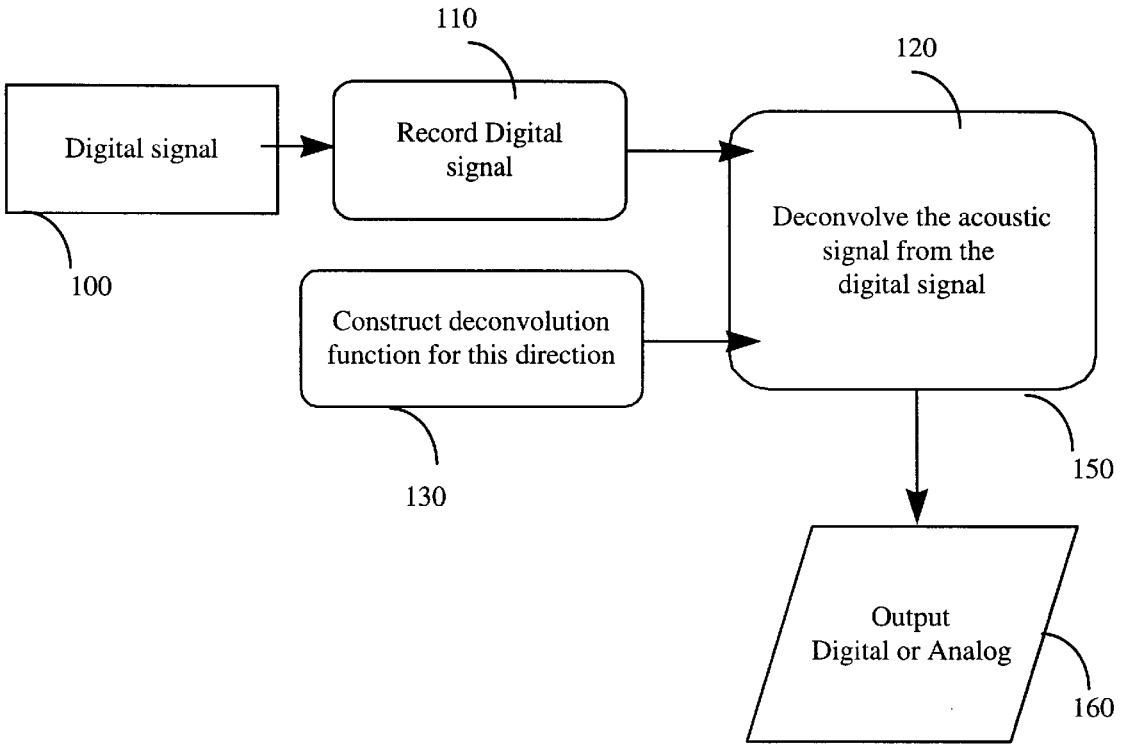
FIG. 4 is a flowchart illustrating the processing steps carried out by the signal processor according to a preferred embodiment of the invention

We will now discuss the method steps carried out by the signal processor 50 according to a preferred embodiment of the invention, with reference to the flowchart of FIG. 4. First the digitized voltage signal 100 is received by the signal processor from the Analog to Digital Converter 65. This digital signal is then recorded and stored 110 in memory (not shown) in order to facilitate the subsequent integration over time. Meanwhile, the signal processor constructs the deconvolution function 130 by retrieving the shape function data w(x) from memory 70 and selecting the direction defined by the angle θ. The value for w'(τ) for each instant of time (value of τ) is recorded. The DSP then calculates (deconvolves) each value of p(0,t) 150 according to Equation 9. The output from the DSP 160 is a digital value of p(0,t) which can of course be converted to an analog signal if desired.

Thus a low noise acoustic wave transducer device has been described. Such an apparatus has many potential applications. For example, a low noise microphone can be built using a sheet of material connected to a signal processor, for example, as illustrated in FIG. 1. This microphone will be very sensitive to sound sources originating from the negative x direction, or from an angle θ to the sheet. Such a microphone can be used to pick up sounds from a particular direction, for example from a podium or stage, by selecting the value of θ used by the DSP in its deconvolution process to correspond to that direction.

Alternatively, the sheet of this material can be connected to a steering mechanism (not shown) to orient the sheet of material into the direction of the sound source.

Furthermore, an acoustic wave transducer device can comprise a plurality of sheets at different orientations, with each sheet sensitive to waves originating from a particular direction. For example an acoustic wave transducer device can comprise two perpendicular sheets. As another example, an array of transducers can be used.

As stated above, it is advantageous to minimize the extent of the sheet in the y-dimension in order to best approximate the assumptions made above (e.g., the pressure exerted on the surface of the transducer by an acoustic wave is only a function of x even when the sound source is not in the xz plane). Selecting a suitable shape function, e.g., $y_s(x)=0$ is one way of doing this, for any given width function. Minimizing the width of the sheet itself would also help in this regard, as a sheet with an infinitesimal width would satisfy the above assumptions for any sound source. Thus the smaller the width, the more likely the assumptions set out in the examples above will hold for any sound source direction. However, as the voltage signal generated by the sheet is a function of the surface, if the width is too narrow, the sheet will not produce a sufficiently strong signal. Thus the width of the sheet can not be too large or too small. To balance these two conflicting constraints, the maximum width of said irregular width should be small enough to make the assumptions hold within the accuracy needed for the application, which, as a general guideline, would be in the order of the acoustic wavelengths of interest.

Furthermore, while a transducer preferably comprises a sheet of material, the device does not require the sheet be confined to a two dimensional plane. The transducer was described in terms of a two-dimensional sheet in order to simplify the processing as described. However, the surface of the sheet can de deformed, provided that the acoustic signal still arrives at each region of the sheet as it otherwise would without changing the voltage signal output of the transducer. Thus the sheet can be deformed in the y and z directions, as long as the x-coordinate does not change and the width as a function of x does not change. For example, the sheet can be bent in the form a cylinder (with the x-axis parallel to the cylindrical axis), or even in the form of an accordion (wherein the width function is folded into itself). Advantageously, these deformations can be utilized to effectively reduce the extent of the transducer in the y-direction.

Although we have described a transducer device which comprises both the transducer and a signal processor coupled together, it should be noted that a transducer device comprising the transducer alone may be useful for some applications. As described above, the transducer transforms the acoustic signal into another form, by convolving the acoustic signal with the width function of the transducer. The DSP was then used to deconvolve the resulting voltage signal in order to retrieve the original acoustic signal. However, for some applications, the convolved signal itself can be useful. The transducer can be used to obtain a signal dependent on an acoustic wave convolved with any function for which we can construct a corresponding shape. This is advantageous as, according to conventional techniques, a sophisticated DSP or computer is needed for applications which require a signal to be convolved with a known function.

Thus, according to another embodiment of the invention, if an application requires a signal to be convolved with a known function, a transducer shaped according to said function can effectively perform the convolution, as its output voltage signal is dependent on said convolution.

Furthermore, if the received signal is already convolved with some function, a transducer shaped according to the corresponding deconvolution function can be used to deconvolve the received signal without requiring a DSP or computer. In this case w(x) represents a desired deconvolution function, rather than a convolution function.

Acoustic wave transducer devices, according to the invention can be useful for many applications, for example microphones, hydrophones, sonar systems, seismographic or seismic exploration systems, etc.

Numerous modifications, variations and adaptations may be made to the particular embodiments of the invention described above without departing from the scope of the invention, which is defined in the claims.

What is claimed is:

1. An acoustic wave transducer device comprising a sheet of material which produces a voltage signal dependent on the shape of the sheet and on the pressure applied to the sheet by acoustic waves traveling in a medium external to, but in contact with, said sheet, wherein said sheet is of an irregular shape;

wherein said irregular shape encodes spatial information into the voltage signal as said acoustic waves travel across the sheet; and wherein said voltage signal includes signal information about said acoustic wave and noise, and wherein said irregular shape is selected to encode said spatial information such that a signal processor which receives said voltage signal can preferentially extract said signal information over the noise from the voltage signal.

2. An acoustic wave transducer device comprising a sheet of material which produces a voltage signal dependent on the shape of the sheet and on the pressure applied to the sheet by acoustic waves traveling in a medium external to, but in contact with, said sheet, wherein said sheet is of an irregular shape wherein the material has properties which are at least approximately described by the equation:

$$V(t) = S_0 \iint_S p(\vec{r}, t)\, dS \tag{1}$$

wherein $\vec{r}$ represents a generalized spatial position vector and $S_0$ is the intrinsic sensitivity of the material in $\frac{\text{Volts}}{\text{Pa m}^2}$.

3. An acoustic wave transducer device as claimed in claim 1 wherein said irregular shape is such that the material forms a sheet with small thickness, an irregular width which varies with the length of the sheet, and a length which is longer then the longest wavelength of the acoustic waves to be received.

4. An acoustic wave transducer device as claimed in claim 3 wherein the maximum width of said irregular width is in the order of the wavelengths of interest.

5. An acoustic wave transducer device as claimed in claim 3 wherein said irregular width varies such that the behavior of said width in a small region of the sheet is different from the behavior of said width at the majority of other regions on the sheet.

6. An acoustic wave transducer device as claimed in claim 5 wherein the irregular width has rapid changes along the length of the sheet.

7. An acoustic wave transducer device comprising a sheet of material which produces a voltage signal dependent on the shape of the sheet and on the pressure applied to the sheet by acoustic waves traveling in a medium external to, but in contact with, said sheet, wherein said sheet is of an irregular shape wherein said shape depends on a transform of a mathematical relation with orthogonal properties.

8. An acoustic wave transducer device as claimed in claim 3, wherein said irregular width depends on the inverse Fourier transform of a mathematical relation with orthogonal properties.

9. An acoustic wave transducer device as claimed in claim 8 wherein said mathematical relation is a pseudo-random noise sequence.

10. An acoustic wave transducer device as claimed in claim 9 wherein said pseudo-random noise sequence is generated from a maximal-length shift register sequence algorithm.

11. An acoustic wave transducer device comprising a sheet of material which produces a voltage signal dependent on the shape of the sheet and on the pressure applied to the sheet by acoustic waves traveling in a medium external to, but in contact with, said sheet, wherein said sheet is of an irregular shape;

wherein the voltage signal produced by said sheet depends on the convolution of acoustic signal information with a width function dependent on said irregular shape, wherein said acoustic signal information is a time dependent function carried by said acoustic waves;

wherein said width function dependent on said irregular shape is selected to correspond to a known function for which the convolution of said known function and said acoustic signal is desired.

12. An acoustic wave transducer device as claimed in claim 3 wherein said sheet is deformed such that the length does not change and the width as a function of length does not change.

13. An acoustic wave transducer device comprising:

a material which produces a voltage signal dependent on the shape of the material and on the pressure applied to the material by an acoustic wave traveling in an external medium, wherein said material is of a predetermined shape; and a signal processor for producing an output signal indicative of the pressure applied to the material as said acoustic waves travel across the material by processing said voltage signal using said predetermined shape;

wherein said signal processor includes a memory for storing shape function data dependent on said predetermined shape.

14. An acoustic wave transducer device as claimed in claim 13 wherein said predetermined shape encodes spatial information about the acoustic wave into said voltage signal as said acoustic waves travel across the material.

15. An acoustic wave transducer device as claimed in claim 14 wherein said voltage signal includes signal information about said acoustic wave and noise, and wherein said signal processor includes means for preferentially extracting said signal information over the noise from the voltage signal.

16. An acoustic wave transducer device as claimed in claim 15 wherein said voltage signal includes signal information about said acoustic wave and noise, and wherein said means for preferentially extracting said signal information over the noise from the voltage signal comprises means for deconvolving said voltage signal using said shape function data.

17. An acoustic wave transducer device as claimed in claim 16 wherein said signal processor includes means for determining the direction from which said acoustic wave originates.

18. An acoustic wave transducer device as claimed in claim 16 wherein said signal processor includes means for increasing the sensitivity of the device to acoustic waves originating from a selected direction.

19. An acoustic wave transducer device as claimed in claim 17 wherein said signal processor includes means for increasing the sensitivity of the device to acoustic waves originating from said direction.

20. An acoustic wave transducer device as claimed in claim 18 wherein said predetermined shape is a sheet with negligible thickness, an irregular width which varies along the length of the sheet, and a length which is longer then the longest wavelength of the acoustic waves to be received, said sheet having a sheet axis and wherein said means for increasing the sensitivity of the device to acoustic waves originating from a selected direction comprises means for selecting an angle between said sheet axis and said selected direction.

21. An acoustic wave transducer device as claimed in claim 13 wherein said predetermined shape is a sheet with negligible thickness, and is irregular in shape.

22. An acoustic wave transducer device as claimed in claim 13 wherein said predetermined shape is a sheet with negligible thickness, an irregular width which varies along the length of the sheet, and a length which is longer then the longest wavelength of the acoustic waves to be received.

23. An acoustic wave transducer device as claimed in claim 22 wherein said signal processor comprises a digital signal processor for deconvolving said voltage signal with said shape function data.

24. An acoustic wave transducer device as claimed in claim 23 wherein said irregular width varies such that the behavior of said width in a small region of the sheet is different from the behavior of said width at the majority of other regions on the sheet.

25. An acoustic wave transducer device as claimed in claim 24 wherein said irregular width has rapid changes along the length of the sheet.

26. An acoustic wave transducer device as claimed in claim 23, wherein said irregular width corresponds to a transform of a mathematical relation with orthogonal properties.

27. An acoustic wave transducer device as claimed in claim 23, wherein said irregular width corresponds to the inverse Fourier transform of a mathematical relation with orthogonal properties.

28. An acoustic wave transducer device as claimed in claim 27 wherein said mathematical relation is a pseudo-random noise sequence.

29. An acoustic wave transducer device as claimed in claim 28 wherein said pseudo-random noise sequence is generated from a maximal-length shift register sequence algorithm.

30. An acoustic wave transducer device comprising a plurality of sheets as claimed in claim 24, a wherein each sheet is oriented to increase the sensitivity in a particular direction.

31. An acoustic wave transducer device as claimed in claim 30 wherein said plurality of sheets comprises a pair of perpendicular sheets.

32. A method of receiving acoustic signal information carried by an acoustic wave traveling in a medium comprising the steps of:

subjecting an acoustic wave transducer material having a predetermined shape to said acoustic wave such that said material will produce a voltage signal which depends on both said shape and the characteristics of said wave as said acoustic waves travel across the sheet;

processing said output signal to produce a desired signal which varies with the characteristics of said wave by using said predetermined shape;

wherein the voltage signal depends on the convolution of the acoustic signal information with a width function dependent on said predetermined shape and wherein said processing step comprises deconvovling said voltage signal with said width function.

* * * * *